US007410343B2

(12) United States Patent
Wakazono et al.

(10) Patent No.: US 7,410,343 B2
(45) Date of Patent: Aug. 12, 2008

(54) GAS TURBINE

(75) Inventors: Susumu Wakazono, Takasago (JP); Kouichi Ishizaka, Takasago (JP); Masanori Yuri, Takasago (JP); Ronald Takahashi, Miami, FL (US)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 390 days.

(21) Appl. No.: 11/196,388

(22) Filed: Aug. 4, 2005

(65) Prior Publication Data

US 2007/0025847 A1 Feb. 1, 2007

Related U.S. Application Data

(63) Continuation-in-part of application No. 10/314,212, filed on Dec. 9, 2002, now abandoned.

(51) Int. Cl.
*F04D 29/04* (2006.01)

(52) U.S. Cl. ..... 415/208.1

(58) Field of Classification Search ..... 415/142, 415/191, 207, 208.1, 208.2, 211.2
See application file for complete search history.

(56) References Cited

U.S. PATENT DOCUMENTS

| | | | |
|---|---|---|---|
| 3,909,156 | A | 9/1975 | Stahl |
| 4,044,555 | A | 8/1977 | McLoughlin et al. |
| 4,076,452 | A | 2/1978 | Hartmann |
| 4,989,406 | A | 2/1991 | Vdoviak et al. |
| 5,609,467 | A | 3/1997 | Lenhart et al. |
| 6,000,906 | A | 12/1999 | Draskovich |

FOREIGN PATENT DOCUMENTS

| | | |
|---|---|---|
| GB | 685 939 | 1/1953 |
| GB | 744 920 | 2/1956 |
| GB | 866 555 | 4/1961 |
| GB | 1 179 009 | 1/1970 |
| GB | 1 222 902 | 2/1971 |
| JP | 4-30348 | 7/1992 |
| JP | 8-100674 | 4/1996 |
| JP | 3165611 | 3/2001 |

*Primary Examiner*—Edward K. Look
*Assistant Examiner*—Dwayne J White
(74) *Attorney, Agent, or Firm*—Oblon, Spivak, McClelland, Maier & Neustadt, P.C.

(57) ABSTRACT

An outer shape of a section in the longitudinal direction at a leading edge of the strut is an aerofoil whose thickness is gradually increased along a flow direction of the combustion gas to prevent reduction of turbine efficiency caused by a shock wave generated at the strut of the exhaust diffuser.

5 Claims, 5 Drawing Sheets

GAS TURBINE

BACKGROUND OF THE INVENTION

1. Field of the Invention

The present invention relates to a gas turbine.

2. Description of Related Art

A gas turbine is equipped with a compressor, a combustor, and a turbine. In the gas turbine, air is compressed in the compressor and flows into the combustor where it is mixed with fuel and combustion occurs. The combustion gas flows into the turbine where energy is extracted from the gas to rotate the compressor and to drive a generator to generate electricity. After flowing through the turbine, the combustion gas is exhausted through an exhaust diffuser.

FIG. 4 shows an example of a turbine equipped with an exhaust diffuser. The turbine consists of multiple stationary airfoils (vanes, not shown) attached to outer casing 3, and multiple rotating airfoils 2 (blades) which are attached to rotor shaft 1, which rotates about centerline CL. The gas flow, F, is in the direction or left to right on FIG. 4. The turbine can consist of multiple pairs of vanes and blades (stages) attached to rotor 1. FIG. 4 shows the blade of the last stage of the turbine.

The exhaust diffuser, consisting of parts 5, 6, 7, and 8 is connected coaxially to the downstream end of the turbine. The exhaust diffuser consists of exhaust casing 6 which encases gasflow path 5 and multiple struts 8 which support journal bearing 7 which in turn supports rotor 1.

Each strut 8 is equipped with strut main body 8*a*, that supports journal bearing 7, and strut cover 8*b* that covers and protects strut main body 8*a* from the combustion gas F.

In the above conventional gas turbine, strong shock waves can form at the leading edge of each strut cover 8*b*, resulting in reduced turbine performance. FIG. 5 shows the conventional cross section A-A of strut 8. The shape of strut cover 8*b* consists of parallel lines in the flow direction connected by semicircles at the leading edge LE and trailing edge TE.

As the combustion gas F, having high Mach number (for example, M=0.65), flows over the strut leading edge, the flow speed rapidly increases to achieve supersonic speed. A shock is generated in the regions indicated by "a" of FIG. 5. The presence of the shock has the effect of reducing turbine efficiency.

This effect on turbine efficiency is increased when the ambient temperature (temperature at the compressor inlet) is low. The amount of air flowing into the gas turbine at low ambient temperature is larger than that at normal ambient temperature, and as a result, the Mach number of the combustion gas flowing into the exhaust diffuser is increased. Accordingly, the shock wave generated at the leading edge LE becomes stronger, resulting in further reductions in turbine efficiency.

BRIEF SUMMARY OF THE INVENTION

In view of the above problems, an object of the present invention is the provision of a gas turbine which can prevent reduction of turbine efficiency caused by the shock wave generated at struts of the exhaust diffuser.

In order to solve the above problems, the following means is adopted in the present invention.

The shape of the strut cover, 8*b* of FIG. 5, is modified to prevent or minimize the generation a shock at the leading edge. As a result, reduction of turbine efficiency due to the shock is reduced or prevented.

DETAILED DESCRIPTION OF THE INVENTION

The present invention and its use in the gas turbine are explained below with reference to the figures. However, as a matter of course, the present invention is not limited to the present embodiment.

Figure 1:
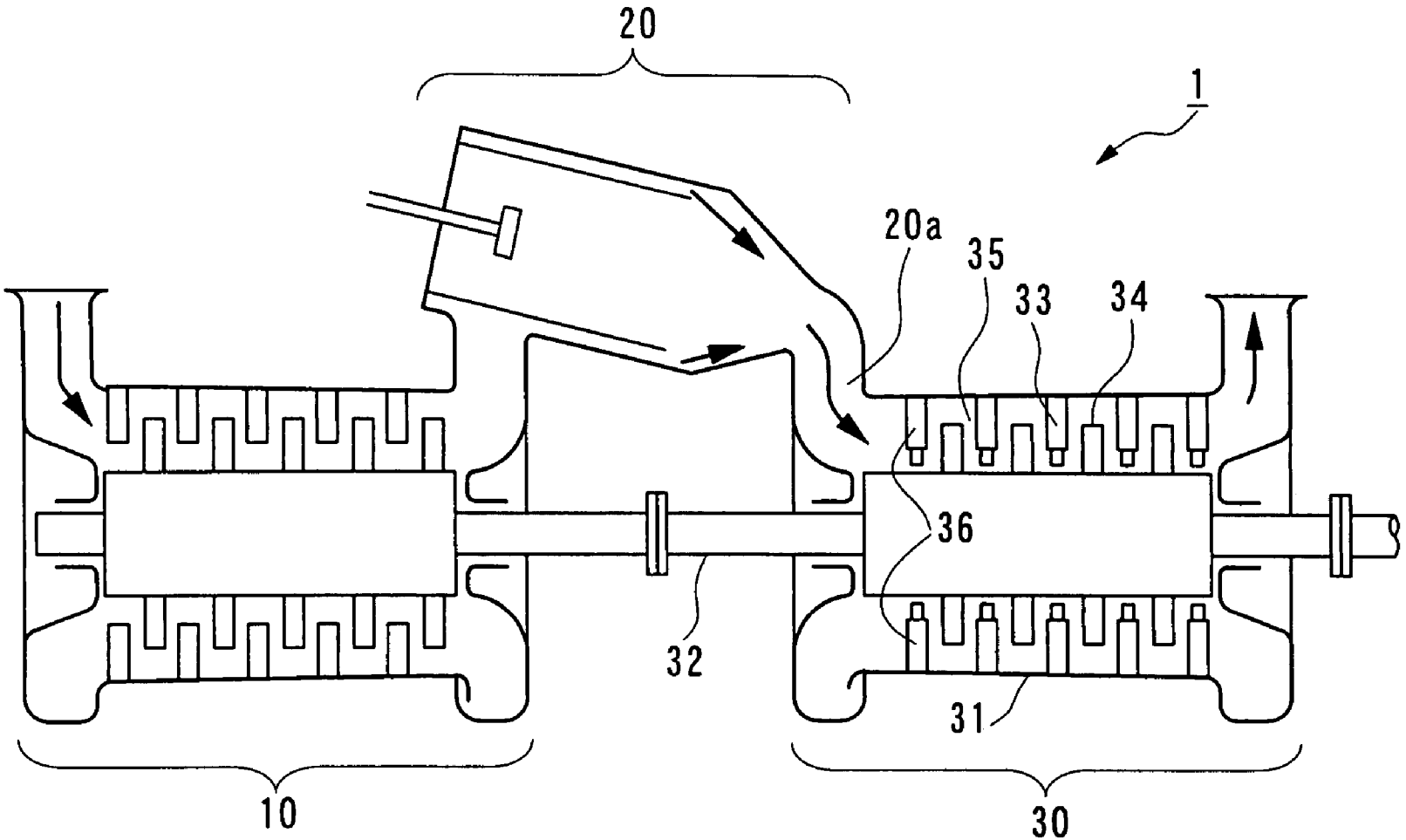
FIG. 1 is a view explaining a schematic structure of an embodiment of a gas turbine according to the present invention.

FIG. 1 shows a schematic structure of the gas turbine of the present embodiment. FIG. 1 shows compressor 10, combustor 20, and turbine 30. Compressor 10 takes up and compresses a large amount of air therein. Combustor 20 carries out combustion after mixing air compressed in compressor 10 and fuel. The combustion gas generated in combustor 20 is introduced into turbine 30 where it is expanded, and is run through moving blades 34 attached to rotor 32 to convert heat energy of the combustion gas into mechanical rotation energy, and as a result, power is generated. In the gas turbine, generally, a part of the power obtained in turbine 30 is used as power for compressor 10.

Multiple moving blades 34 attached to rotor 32 and also multiple stationary vanes 33 attached to casing 31 (stationary member side) are equipped in turbine 30. Moving blades 34 and stationary vanes 33 are alternately placed along the rotational shaft line of rotor 32. When rotor 32 is connected with a generator (not shown), power generation can be carried out.

Casing 31 forms combustion gas flow path 35 therein by covering the periphery of moving blades 34 and rotor 32. Casing 31 corresponds to a combination of turbine casing 3 and exhaust casing 6 of FIG. 4.

Figure 2:
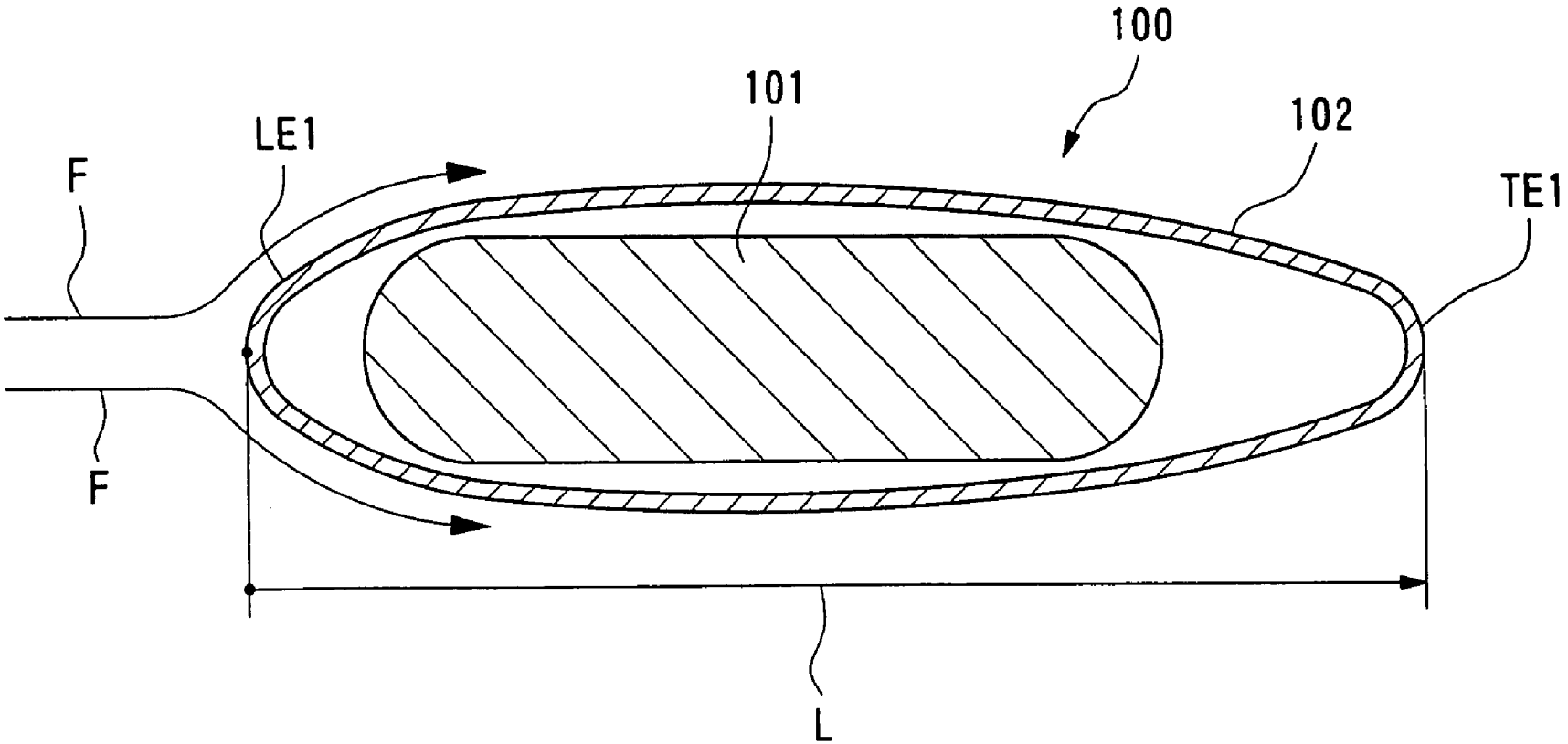
FIG. 2 is a sectional view showing the outer shape of a strut of an exhaust diffuser.
Figure 4:
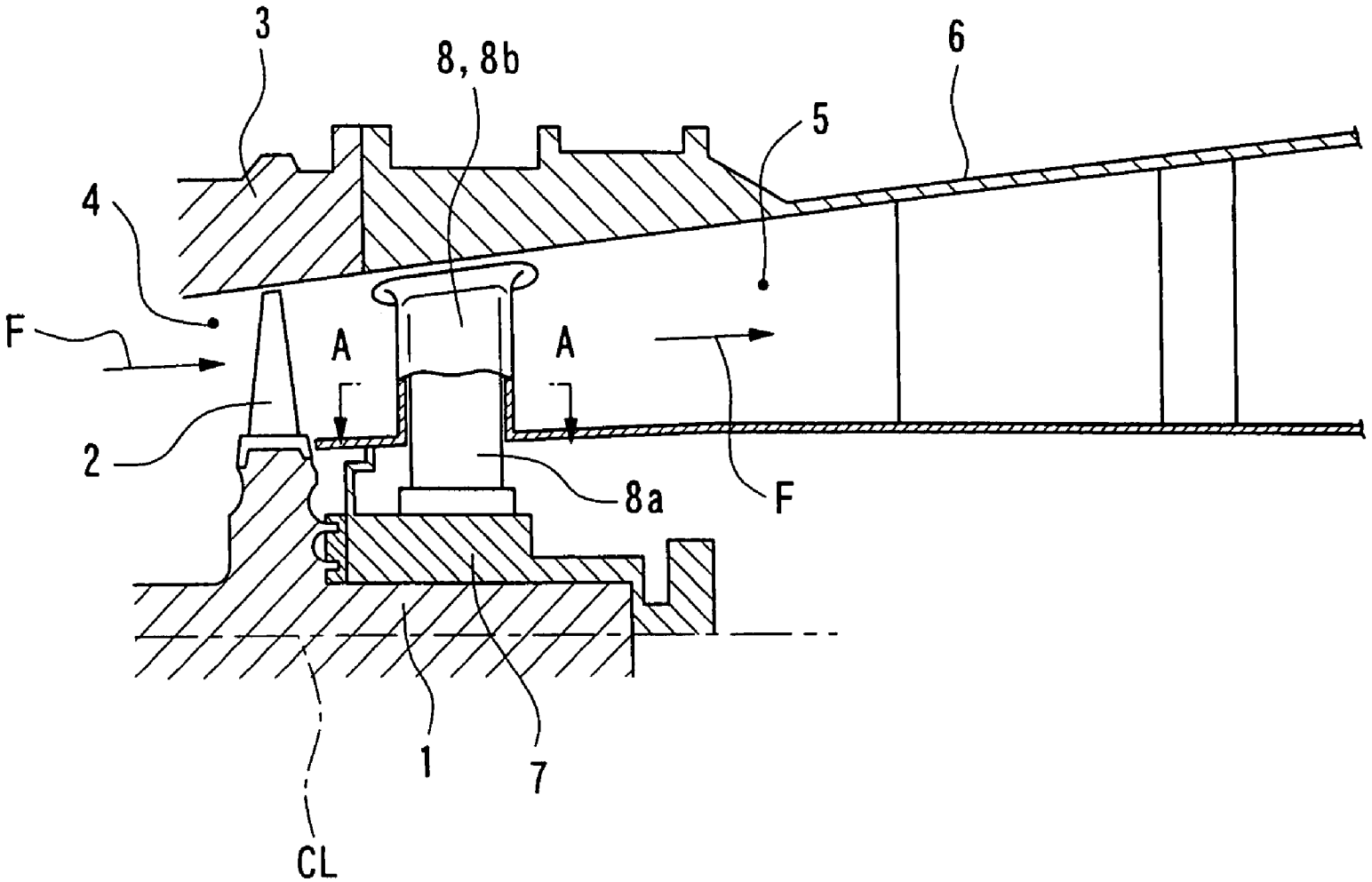
FIG. 4 PRIOR ART
FIG. 4 is a sectional view along the rotational shaft line of the rotor, showing a structure of the turbine and exhaust diffuser.
Figure 5:
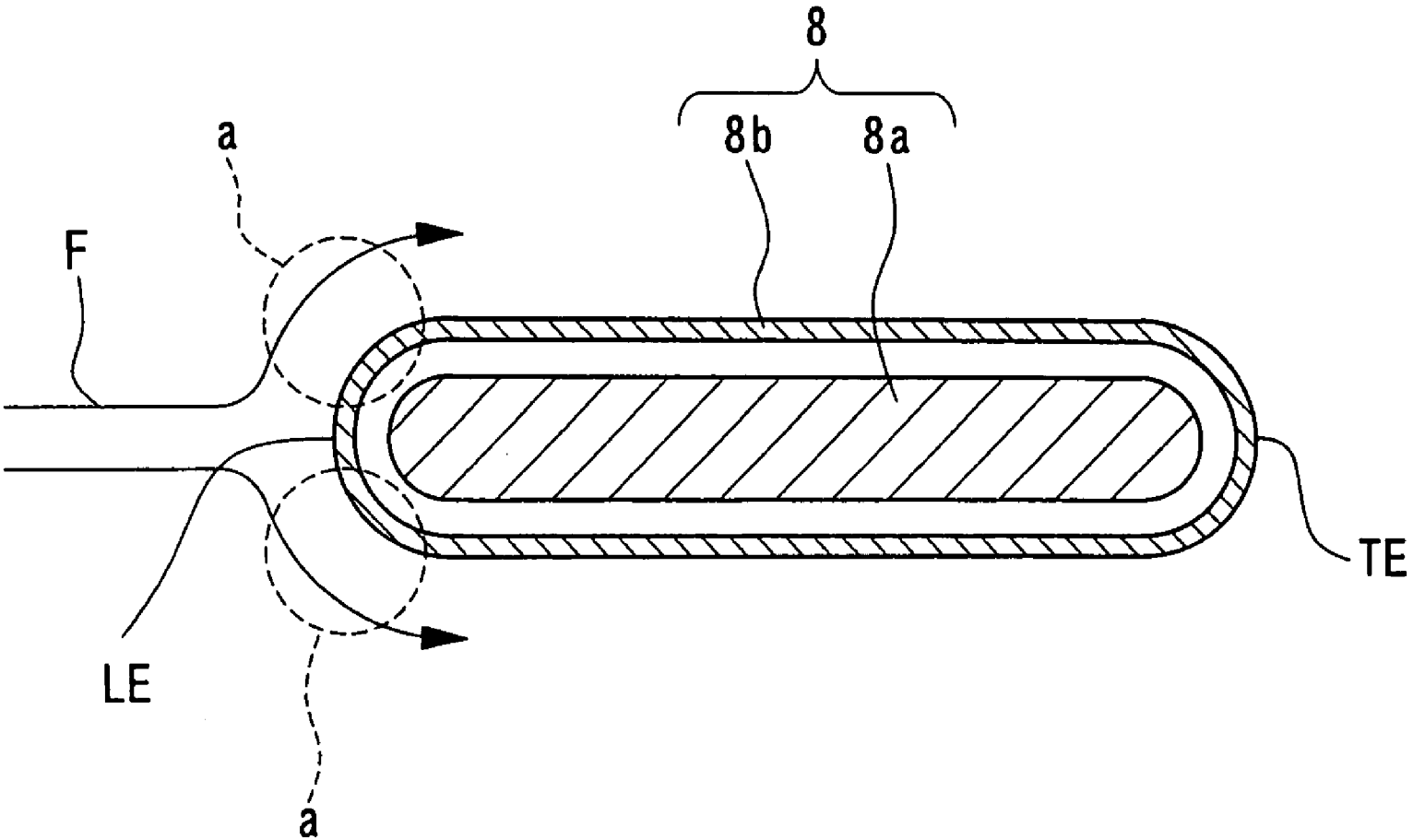
FIG. 5 PRIOR ART
FIG. 5 is a sectional view showing the outer shape of a conventional strut equipped in the exhaust diffuser along line A-A shown in FIG. 4.

The details of the shape of strut 8 is described as follows:

FIG. 2 corresponds to a cross-section along line A-A shown in FIG. 4. As shown in FIG. 2, a strut (given reference number 100 to discriminate from conventional strut 8) of the present embodiment comprises strut main body 101 which supports rotor 1 with journal bearing 7, and strut cover 102 which covers and protects strut main body 101 from the combustion gas F.

The outer shape of the cross-section of strut cover 102 is a wing shape in which the thickness of leading edge LE1 is gradually increased along the flow direction of the combustion gas F. The strut leading edge of the present invention is elliptical in shape, compared to semi-circular for the conventional strut.

Figure 3:
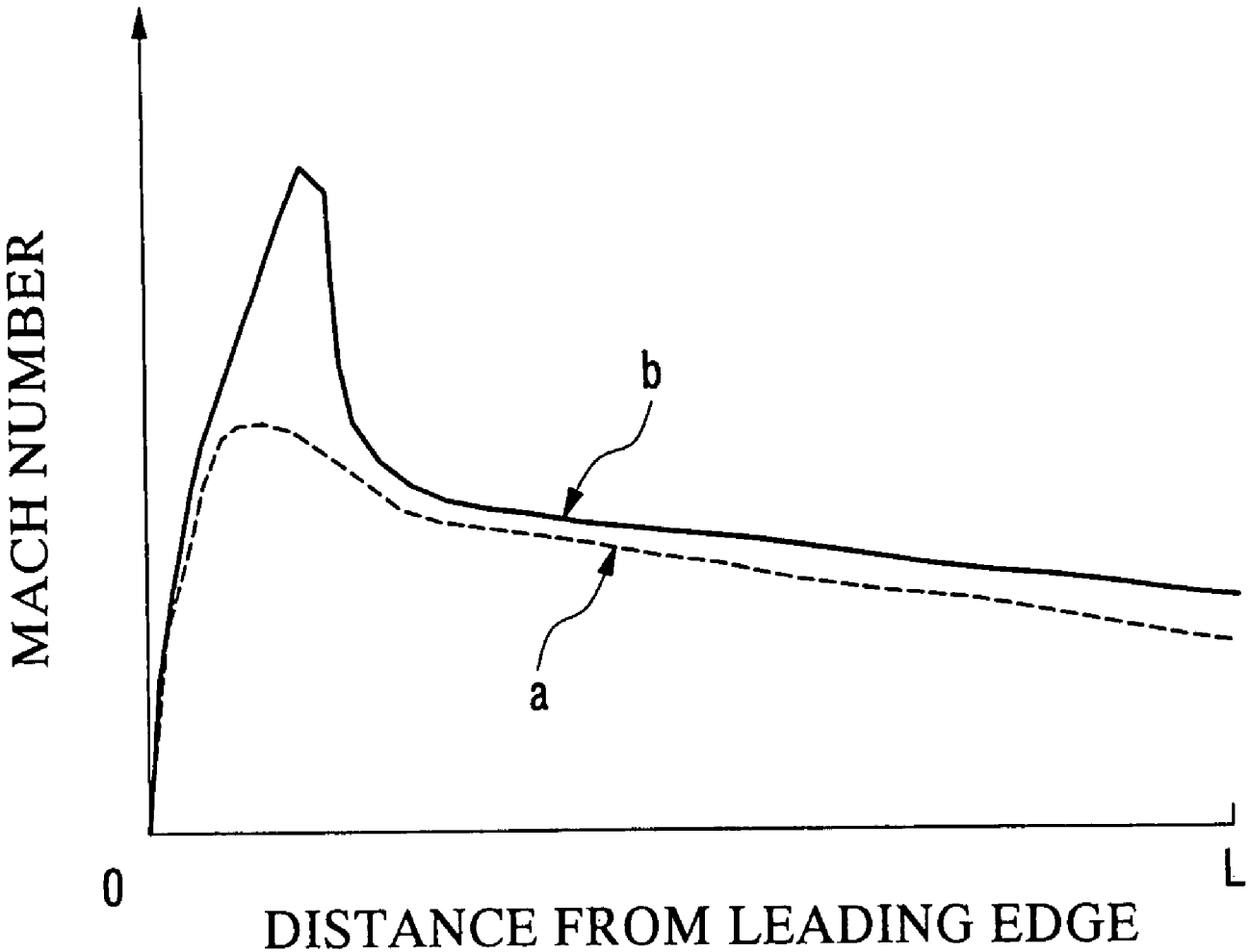
FIG. 3 is a graph showing Mach number distribution along the strut of the gas turbine, in which x-axis indicates distance from a leading edge in the direction of gas flow, and y-axis indicates Mach number.

Using the leading edge LE1 with the wing shape being tapered with an elliptical shape, the combustion gas F flowing into the leading edge LE1 can flow along a smoothly curved surface of the leading edge LE1. As indicated by the dashed line a shown in FIG. 3, it can prevent the Mach number at the leading edge LE1 from rapidly increasing (the continuous line b indicates Mach number when the leading edge has the conventional obtuse head shape). Since forming of strong shock wave caused by high Mach number can be prevented, reduction of turbine efficiency due to shock formation can be reduced or prevented.

In the present embodiment, the trailing edge TE1 has a wing shape as well as the leading edge LE1, however, the shape of the trailing edge TE1 is not limited, the trailing edge TE1 may have the obtuse head shape or rectangle as if curved portion is simply cut off.

Furthermore, the outer shape of strut cover 102 may be an NACA blade in a cross-section thereof in addition to the shape shown in FIG. 2.

As an example of the invention, a Mach number ratio has a peak approximately 2.2 at 11% distance from the leading edge (LE1), and is approximately 1.7 at 27% distance from the leading edge (LE1), under the conditions that distance from the leading edge (LE1) is indicated in percentage with reference to a length (L) of the strut cover 102, and speed of the combustion gas flowing along the strut cover 102 is indicated as Mach number ratio with reference to a speed of the combustion gas at the trailing edge (TE1).

What is claimed is:

1. A gas turbine comprising:

moving blades attached to a rotor;

an exhaust diffuser comprising a strut main body configured to support the rotor provided therein, the exhaust diffuser being configured to take up combustion gas at an exit of the moving blades to recover pressure; and a strut cover configured to protect the strut main body from the combustion gas and to reduce shock formation in a trailing edge region of said strut cover, wherein an outer shape of a section in the longitudinal direction at a leading edge of the strut cover is elliptical in shape and whose thickness gradually increases initially along a flow direction of the combustion gas, and a Mach number ratio has a peak approximately 2.2 at 11% distance from the leading edge (LE1), and is approximately 1.7 at 27% distance from the leading edge (LE1), under the conditions that distance from the leading edge (LE1) is indicated in percentage with reference to the length (L) of the strut cover, and speed of the combustion gas flowing along the strut cover is indicated as Mach number ratio with reference to a speed of the combustion gas at the trailing edge (TE1).

2. The gas turbine according to claim 1, wherein an outer shape of a section in the longitudinal direction at a trailing edge of the strut cover is a semicircular shape.

3. The gas turbine according to claim 1, wherein said thickness is substantially constant over said strut main body.

4. The gas turbine according to claim 1, wherein a trailing edge of said strut cover is one of an obtuse, a rectangle, and a cut-off curved portion.

5. The gas turbine according to claim 1, wherein said strut cover is hollow.

* * * * *